US007537199B1

(12) United States Patent
Anderson

(10) Patent No.: US 7,537,199 B1
(45) Date of Patent: May 26, 2009

(54) RATCHET PULLEY DEVICE FOR TIGHTENING CORDS OR ROPES

(75) Inventor: Robert L. Anderson, Durham, NC (US)

(73) Assignee: Carolina North Manufacturing, Inc., Kernersville, NC (US)

( * ) Notice: Subject to any disclaimer, the term of this patent is extended or adjusted under 35 U.S.C. 154(b) by 0 days.

(21) Appl. No.: 12/019,469

(22) Filed: Jan. 24, 2008

(51) Int. Cl.
*B66D 3/04* (2006.01)

(52) U.S. Cl. ..... 254/411; 254/391; 254/223

(58) Field of Classification Search ..... 254/391, 254/411, 223, 217, 371, 902
See application file for complete search history.

(56) References Cited

U.S. PATENT DOCUMENTS 4,293,121 A * 10/1981 Wallin ..... 254/370
4,399,979 A * 8/1983 Adelman ..... 254/338
4,977,795 A * 12/1990 McVey ..... 74/575
5,238,227 A 8/1993 White ..... 254/372
5,368,281 A * 11/1994 Skyba ..... 254/391
5,402,985 A 4/1995 Owens et al. ..... 254/333
5,722,640 A 3/1998 Skyba ..... 254/333
6,092,791 A 7/2000 Kingery ..... 254/371
6,149,133 A 11/2000 Skyba ..... 254/391

* cited by examiner

*Primary Examiner*—Emmanuel M Marcelo
(74) *Attorney, Agent, or Firm*—MacCord Mason PLLC

(57) ABSTRACT

A ratcheting pulley device is shown and described. In one embodiment, the device includes a sheave rotatably mounted in a housing. The housing defines an opening for ingress and egress of a rope or cord into the housing and around the sheave. The device includes a releasable ratchet mechanism, which, when engaged, permits rotation of the sheave in one direction but not the other, and which, when released, permits free rotation of the sheave. A loading-disk is mounted on the exterior of the housing and is in rotational communication with the sheave. The loading-disk allows rope or cord to be operably and quickly loaded into the device.

18 Claims, 5 Drawing Sheets

--PRIOR ART--

--PRIOR ART--

--PRIOR ART--

RATCHET PULLEY DEVICE FOR TIGHTENING CORDS OR ROPES

BACKGROUND (1) Field of Technology

The present invention relates generally to ratchet pulley devices for tightening cords or ropes, and more particularly to a thumb-drive for facilitating the movement of loose rope through the device.

(2) Description of the Related Art

Rope winches are generally known in the art. See, for example, FIG. 1, showing a winch described in U.S. Pat. No. 5,722,640, the entire contents of which are hereby incorporated by reference. As seen in FIG. 1, winch 2 includes a rotatably mounted lever 4. The rotation of lever 4 tightens rope 6, which pulls object 10 in the general direction of winch 2. Lever 4 provides a mechanical advantage needed in many instances to move large loads.

In contrast to rope winches, which are designed to move objects, ratchet pulley devices for tightening cords and ropes are structurally configured for securing objects in a desired location. FIGS. 2 and 3 show an example of a device 30 described in U.S. Pat. No. 5,368,281, the entire contents of which are hereby incorporated by reference. Referring primarily to the exploded view provided in FIG. 3, device 30 includes sheave 32, which may be made of sheave-halves 32A and 32B. Sheave 32 is rotatably mounted within housing 34. Ratchet mechanism 36 has tooth 36A that is biased by spring 40 to engage sprocket 32C of sheave 32. Housing 34 also defines channel 34A, which helps guide rope around sheave 32.

Referring primarily to FIG. 2, sheave 32 engages rope 42, which has a tag-end 42A and a main body 42B that is securable to an object, e.g., a canoe on top of a car (not shown). The opposite end of housing 32 is connected to hook 46, which is securable to a stable object, e.g., flange 48. The object to be secured (not shown) is quickly and easily secured by pulling on tag-end 42A of rope 42, which ratchetably tightens the main body 42B of rope 42, thereby preventing backwards slip of rope 42.

With conventional ratchet pulley devices, it is common to provide an opening 44 in housing 34 through which sheave 32 is accessible. Opening 44 can be used to manually rotate sheave 32, which may be needed, depending on the stiffness or type of rope used, to load rope into the sheave. While generally adequate for loading most ropes, applicant has found that accessing sheave 32 by opening 44 to load ropes is relatively time consuming due to the structurally-constrained length of opening 44, which allows for only a partial-rotation of the sheave. Using the conventional ratchet pulley device, numerous (e.g., 5-10) partial-rotations of the sheave may be required to load the rope around the sheave into operable position. When using a single ratcheting pulley device, this large number of partial-rotations is undesirable. When using a large number of ratcheting pulley devices, both the number of partial-rotations required to load the rope, and the undesirability, are amplified.

The present invention addresses these and other problems by providing a structural solution that allows for quick and easy loading of the rope onto the sheave with a single movement of the thumb.

SUMMARY

Accordingly, one aspect of the present invention is to provide a ratcheting pulley device that allows for quick and easy loading of rope on the sheave.

Another aspect of the present invention is to provide a ratcheting pulley device that allows for rope to be loaded onto the sheave in a single motion.

Another aspect of the invention is to provide a loading-disk for rotating the sheave of a ratcheting pulley device.

Still another aspect of the present invention is to provide a substantially snag-free loading-disk on a device, which is configured to reduce the possibility of snag during operation.

In summary, one embodiment of a ratcheting pulley device of the present invention includes a sheave rotatably mounted in a housing. The housing defines an opening for ingress and egress of a rope or cord into the housing and around the sheave. The device includes a releasable ratchet mechanism, which, when engaged, permits rotation of the sheave in one direction but not the other, and which, when released, permits free rotation of the sheave. A loading-disk is mounted on the exterior of the housing and is in rotational communication with the sheave. The loading-disk provides advancement in that it allows the device to be operably and quickly loaded with a rope or cord.

The above summary was intended to summarize certain embodiments of the present invention. Structures of the present invention will be set forth in more detail in the figures and detailed description below. It will be apparent, however, that the detailed description is not intended to limit the present invention, the scope of which should be properly determined by the appended claims.

DESCRIPTION OF THE PREFERRED EMBODIMENTS

Figure 4:
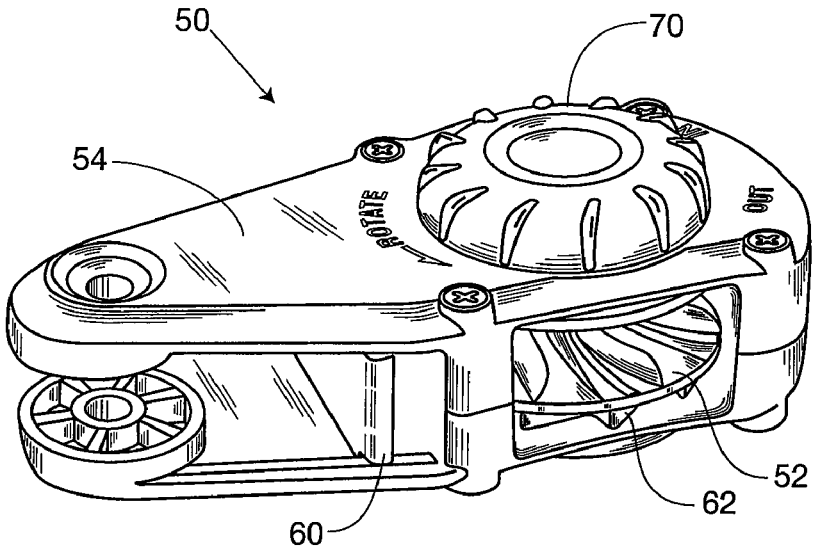
FIG. 4 shows a side perspective view of one embodiment of the invention.
Figure 5:
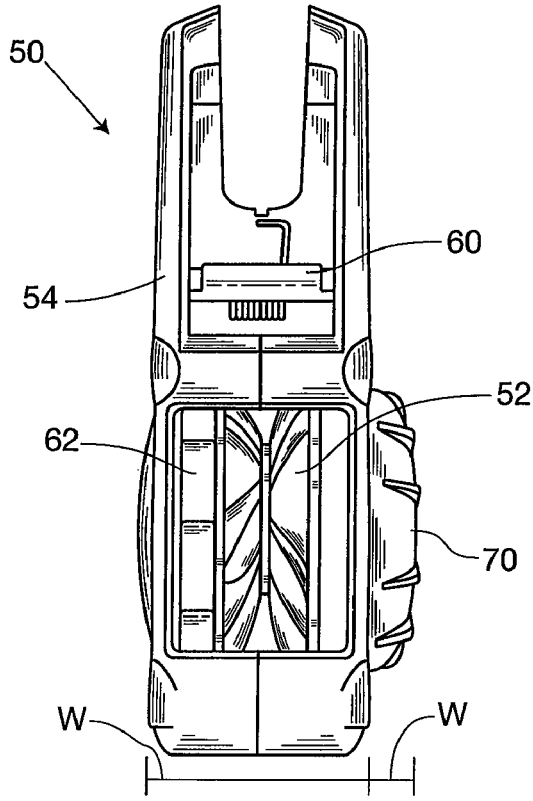
FIG. 5 shows a side view of the device shown in FIG. 4.
Figure 6:
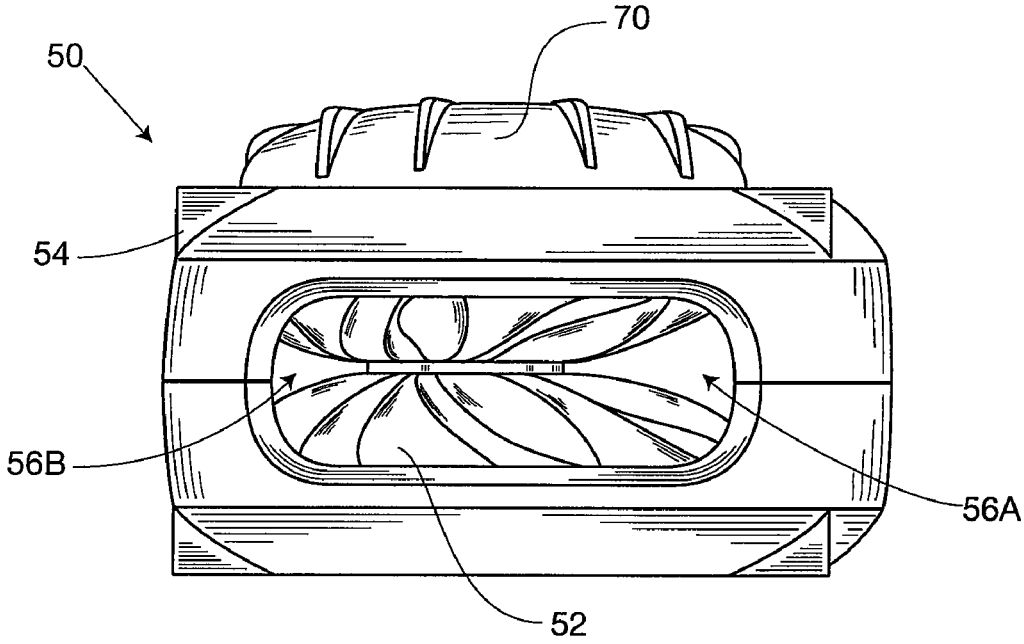
FIG. 6 shows a bottom view of the device shown in FIG. 4.

FIG. 4 shows a side perspective view of one embodiment of an improved ratchet pulley device 50 according to the present invention. FIG. 5 shows a side view of device 50. FIG. 6 shows a bottom view of device 50. Referring generally to FIGS. 4, 5 and 6, device 50 includes sheave 52 having two opposed faces, which is rotatably mounted in housing 54. As best seen in FIG. 6, housing 54 defines an opening 56A for ingress of a rope or cord into housing 54 and around sheave 52. Housing 54 also defines an opening 56B for the egress of the rope. As seen in this embodiment, opening 56A and 56B are a single opening, but others, in other embodiments may prefer two distinct openings, and such embodiments are considered to be within the scope of the present invention.

Figure 1:
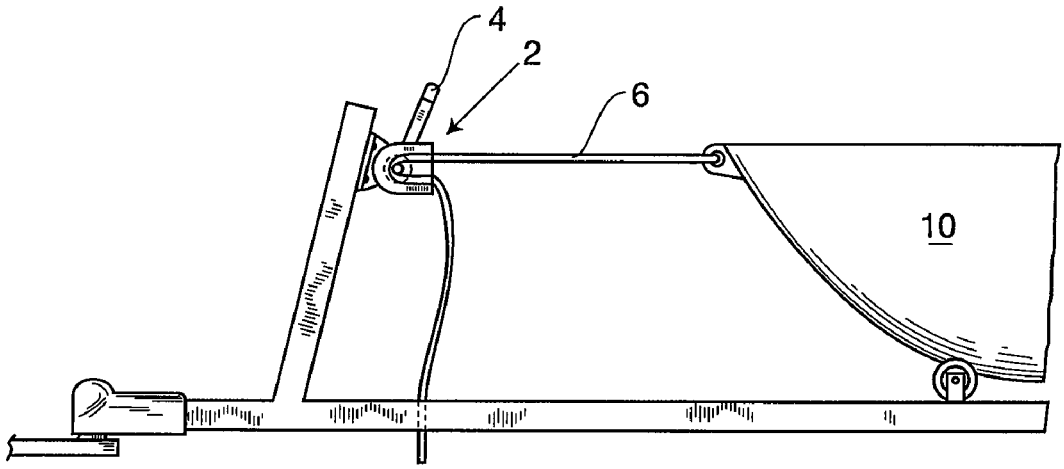
FIG. 1 shows a prior art rope winch in use.
Figure 2:
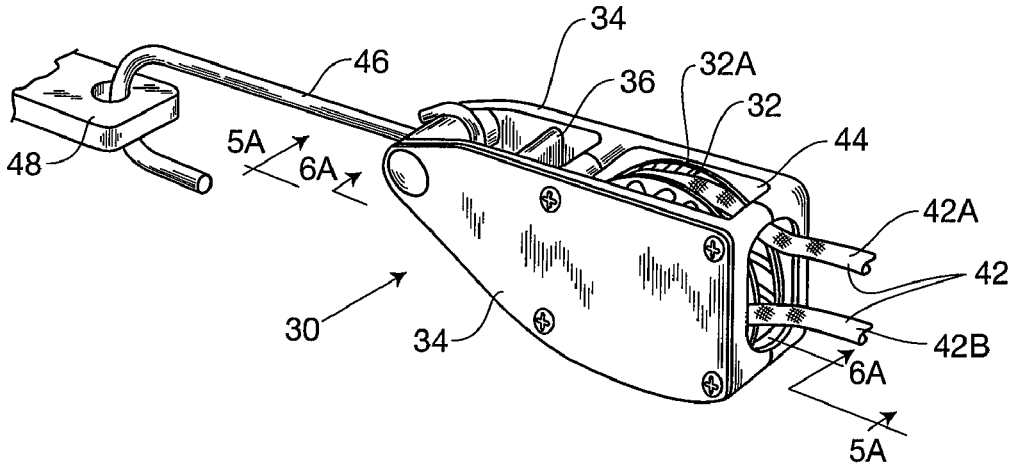
FIG. 2 shows a close up, side view of a prior art ratchet pulley device.
Figure 3:
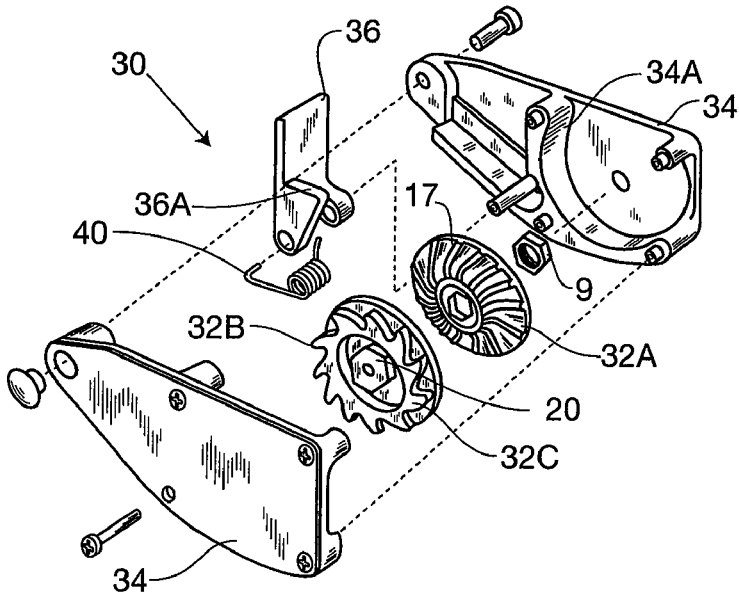
FIG. 3 shows an exploded view of the device shown in FIG. 2.

Device 50 includes releasable ratchet mechanism 60, which, when engaged, permits rotation of sheave 52 in one direction but not the other, and which, when released, permits free rotation of sheave 52. Ratchet mechanism 60 includes a tooth (similar to the tooth shown in the mechanism in FIG. 3) configured to engage sprocket 62 of sheave 52.

Loading-disk 70 is mounted on the exterior of housing 54 and is in rotational communication with sheave 52. Rotational communication is typically achieved by connected loading-disk 70 to sheave 52 with a shaft (not visible). Loading-disk 70 allows device 50 to be operably and quickly loaded with a rope or cord. In most preferred embodiments, loading-disk 70 will be substantially circular, as shown, with a diameter approximately equal to the diameter of the sheave. Others, in other embodiments, may prefer other shapes, which are considered to be within the scope of the present invention.

Figure 7:
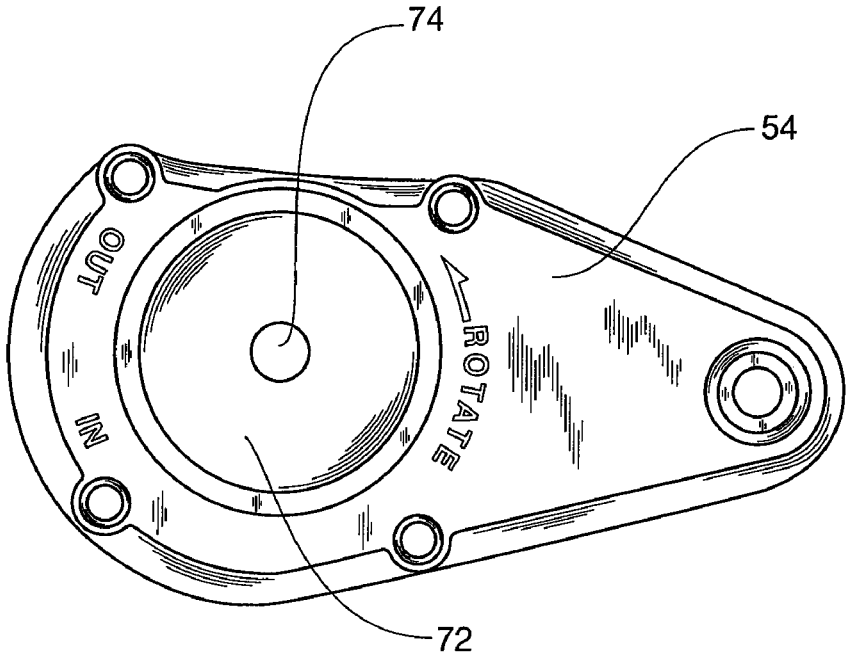
FIG. 7 shows a partial view of the device shown in FIG. 4.

Loading-disk 70 is also preferably substantially flat, as shown, to minimize the profile of the loading-disk, and to reduce snag when device 50 encounters snagable objects or materials during use. Referring to FIG. 5, the width W' of loading disk is less than the width W of device 50. In preferred embodiments, W' is about 8% to about 35% of the total width (W+W') of device 50, even more preferably W' is about 10% to about 25% of the total width, and even more preferably is about 12% to about 18% of the total width. To further reduce the profile of loading-disk 70, yet maximize its thickness and structural integrity, applicant prefers to position the loading-disk in a recess defined in the exterior of the housing. For example, FIG. 7 shows recess 72 defined in exterior of housing 54 substantially adjacent to the sheave, which is configured to receive a loading-disk, e.g., loading-disk 70. FIG. 7 also shows an aperture 74 defined by the housing substantially adjacent to the sheave, through which a shaft connecting the sheave to the loading-disk can be positioned for establishing rotational communication.

Referring back to FIGS. 4, 5 and 6, it will also be appreciated that loading-disk 70 does not include a lever-arm attached thereto. In contrast to the present invention, winches, etc., possess raised and/or extended lever arms for providing the significant mechanical advantage needed to move objects. Such lever-arms would be undesirable for ratchet pulley devices according to the present invention because they would increase the chance of device-snag and/or damage to other objects during use, and should not be misconstrued as loading-disks.

Figure 8:
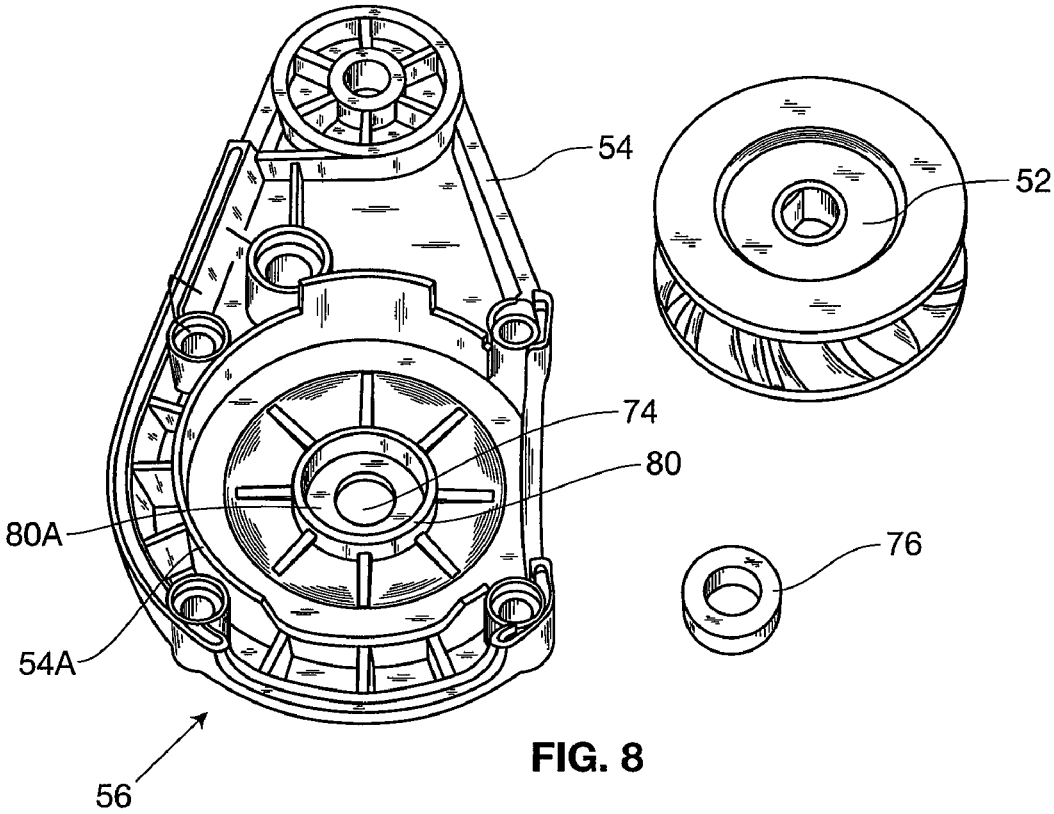
FIG. 8 shows an internal view of a portion of the housing from the device shown in FIG. 4 including additional internal components.
Figure 9:
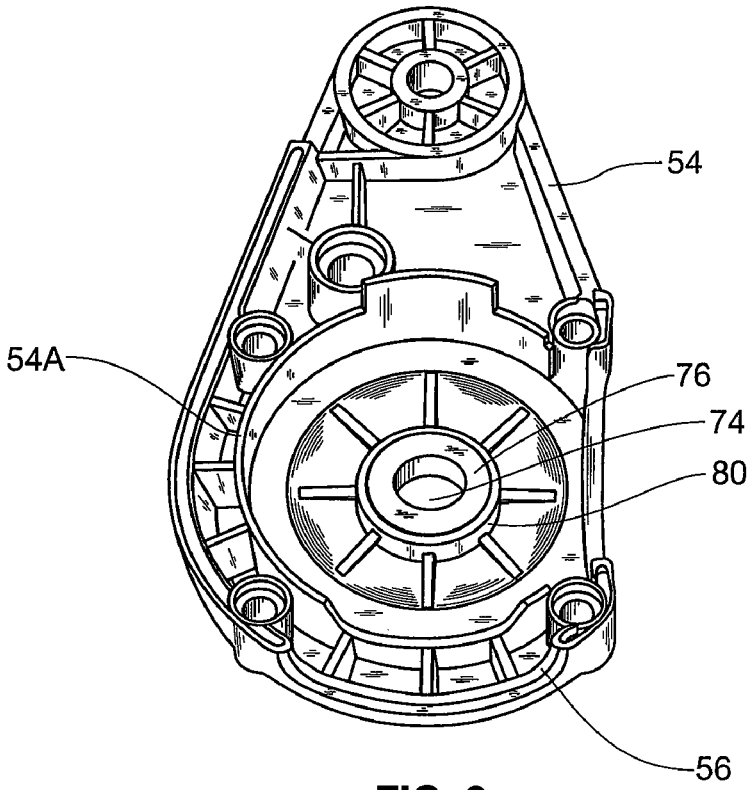
FIG. 9 shows a view similar to the view seen in FIG. 8.

FIG. 8 shows an internal view of a portion of housing 54, bearing 76 and sheave 52. As seen, housing 54 includes curved guiding surface 54A configured to fit closely around the exterior of sheave 52 from ingress opening 56 and extending at least approximately one-half of the circumference of the sheave. In preferred embodiments, the interior of housing 54 substantially adjacent to the sheave also defines a wall 80 substantially surrounding aperture 74 and slightly offset from aperture 74, thereby creating an internal recess 80A configured to receive bearing 76. In preferred embodiments, wall 80 is substantially circular and has a diameter larger than the diameter of aperture 74. FIG. 9 shows bearing 76 positioned in internal recess 80A. When assembled, the bearing facilitates the rotation of the sheave and loading-disk.

Using any variety of the above configurations, a user can quickly and easily load rope or cord into the device and operably around the sheave by placing the rope or cord into the ingress and rotating the loading-disk. In most embodiments, the ratchet pulley device can be loaded using a single hand, with a single movement. For example, the device is held in the palm of the hand with the loading-disk facing up. After the rope or cord is inserted into the ingress, the user can use the thumb of the hand holding the device to rotate the loading-disk in an easy motion, and thereby load the rope onto the sheave and progress it out of the egress the desired distance.

Numerous characteristics and advantages have been set forth in the foregoing description, together with details of structure and function. The novel features are pointed out in the appended claims. The disclosure, however, is illustrative only, and changes may be made in detail, especially in matters of shape, size, and arrangement of parts, within the principle of the invention, to the full extent indicated by the broad general meaning of the terms in which the general claims are expressed. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1% to 10%" or should be considered to include any and all subranges between (and inclusive of) the minimum value of 1% and the maximum value of 10%; that is, all subranges beginning with a minimum value of 1% or more, e.g. 1% to 6.1%, and ending with a maximum value of 10% or less, e.g., 5.5% to 10%, as well as all ranges beginning and ending within the end points, e.g. 2% to 9%, 3% to 8%, 3% to 9%, 4% to 7%, and finally to each number 1%, 2%, 3%, 4%, 5%, 6%, 7%, 8%, 9% and 10% contained within the range. It is further noted that, as used in this specification, the singular forms "a," "an," and "the" include plural referents unless expressly and unequivocally limited to one referent.

I claim:

1. A ratchet pulley device for a rope or cord, said device comprising:

a rotatable sheave;

a housing within which said sheave is rotatably mounted, said housing having an opening for ingress of a rope or cord into said housing and around said sheave and an opening for egress thereof from said housing, a curved guiding surface in said housing closely fitting around the exterior of said sheave from said ingress opening and extending at least approximately one-half of the circumference of said sheave in the direction of rotation thereof;

a releasable ratchet mechanism which, when engaged, permits rotation of said sheave in one direction but not the other, and which, when released, permits free rotation of said sheave; and a loading-disk mounted on the exterior of said housing in rotational communication with said sheave, thereby allowing a user to load a rope or cord onto said sheave by the rotation of said loading-disk.

2. The device of claim 1, wherein the exterior of said housing substantially adjacent to said sheave defines a recess configured to receive said loading-disk, thereby lowering the profile of said loading-disk.

3. The device of claim 1, wherein the exterior of said housing substantially adjacent to said sheave defines an aperture through which a shaft connecting said sheave to said loading-disk is positioned, thereby establishing said rotational communication between said sheave and said loading disk.

4. The device of claim 3, wherein the interior of said housing substantially adjacent to said sheave defines a wall slightly offset from, and substantially surrounding, said aperture, thereby creating an internal recess configured to receive a bearing.

5. The device of claim 4, wherein said wall defined by said interior of said housing is substantially circular.

6. The device of claim 4, further including a bearing positioned in said internal recess.

7. The device of claim 1, wherein said loading-disk is substantially circular and has a diameter approximately equal to the diameter of said sheave.

8. The device of claim 1, wherein said loading-disk is substantially flat.

9. The device of claim 1, wherein said loading-disk does not include a lever-arm attached to said disk for providing a mechanical advantage.

10. A ratchet pulley device for a rope or cord, said device comprising:

a rotatable sheave having two opposed faces;

a housing within which said sheave is rotatably mounted, said housing having an opening for ingress of a rope or cord into said housing and around said sheave and an opening for egress thereof from said housing, a curved guiding surface in said housing closely fitting around the exterior of said sheave from said ingress opening and extending at least approximately one-half of the circumference of said sheave in the direction of rotation thereof, and defining a substantially circular recess on an exterior side configured to receive a loading-disk;

a releasable ratchet mechanism which, when engaged, permits rotation of said sheave in one direction but not the other, and which, when released, permits free rotation of said sheave; and a loading-disk mounted in said recess defined on the exterior side of said housing in rotational communication with said sheave, thereby allowing a user to load a rope or cord onto said sheave by the rotation of said loading-disk.

11. The device of claim 10, wherein said recess defined in said exterior of said housing is substantially adjacent to said sheave.

12. The device of claim 10, wherein said loading-disk is substantially circular.

13. The device of claim 10, wherein said loading-disk is substantially flat.

14. The device of claim 10, wherein said loading-disk does not include a lever-arm attached to said disk for providing a mechanical advantage.

15. A ratchet pulley device for a rope or cord, said device comprising:

a rotatable sheave having two opposed faces;

a housing within which said sheave is rotatably mounted, said housing having an opening for ingress of a rope or cord into said housing and around said sheave and an opening for egress thereof from said housing, a curved guiding surface in said housing closely fitting around the exterior of said sheave from said ingress opening and extending at least approximately one-half of the circumference of said sheave in the direction of rotation thereof an aperture in said housing substantially adjacent to said sheave through which a shaft is positioned, said shaft connecting said sheave to said loading-disk, thereby establishing said rotational communication between said sheave and said loading disk, and a substantially circular wall defined by the interior of said housing substantially surrounding and offset from said aperture, thereby creating an internal recess configured to receive a bearing;

a bearing positioned in said internal recess defined by said housing;

a releasable ratchet mechanism which, when engaged, permits rotation of said sheave in one direction but not the other, and which, when released, permits free rotation of said sheave; and a substantially flat loading-disk mounted on the exterior of said housing in rotational communication with said sheave, wherein said loading-disk does not include a lever-arm attached to said disk for providing a mechanical advantage, thereby allowing a user to load a rope or cord onto said sheave by the rotation of said loading-disk by using the user's thumb.

16. The device of claim 15, wherein the exterior of said housing defines a recess configured to receive said loading-disk, thereby lowering the profile of said loading-disk.

17. The device of claim 15, wherein said recess is externally adjacent to said sheave.

18. The device of claim 15, wherein said recess is substantially circular.

* * * * *